US005473915A

United States Patent [19]

Hur et al.

[11] Patent Number: 5,473,915

[45] Date of Patent: Dec. 12, 1995

[54] CLOTHES WASHER AGITATOR HAVING A VARIABLE-LENGTH WASHING ROD

[75] Inventors: Woon-Gu Hur; Young-Min Kim, both of Suwon, Rep. of Korea

[73] Assignee: Samsung Electronics Co., Ltd., Suwon, Rep. of Korea

[21] Appl. No.: 271,637

[22] Filed: Jul. 7, 1994

[30] Foreign Application Priority Data

Jul. 8, 1993 [KR] Rep. of Korea ..... 1993-12536

[51] Int. Cl.[6] ..... D06F 17/10

[52] U.S. Cl. ..... 68/134

[58] Field of Search ..... 68/133, 134

[56] References Cited

U.S. PATENT DOCUMENTS 1,869,590 8/1932 Voss ..... 68/133

FOREIGN PATENT DOCUMENTS 53184 3/1985 Japan ..... 68/134

*Primary Examiner*—Philip R. Coe

*Attorney, Agent, or Firm*—Burns, Doane, Swecker & Mathis

[57] ABSTRACT

An oscillatory agitator for a clothes washing machine includes an upstanding washing rod comprised of a plurality of telescopingly arranged rod members which are relatively vertically movable to enable the height of the washing rod to be varied. Raising of the rod members is achieved by making a rod member buoyant, whereby it automatically floats upward to a level dependent upon the height of the wash water.

13 Claims, 10 Drawing Sheets

CLOTHES WASHER AGITATOR HAVING A VARIABLE-LENGTH WASHING ROD

BACKGROUND OF THE INVENTION

1. Field of the Invention

The present invention relates to an agitator for agitating washing water and laundry in a washing tub of a washing machine (washer), and more particularly to an agitator employing an upstanding washing rod.

2. Description of the Prior Art

Currently, clothes washers operate under one of two types of methods mainly, one is a pulsating method and the other is a washing rod method.

The washer of the pulsating method has an advantage in that washing time can be shortened and voluminous laundering is possible by way of strong rotating water current caused by rotation of a pulsator.

However, the washer of the pulsating method has a drawback in that the laundry can be entwined, causing damage to the laundry.

Meanwhile, even though the washer of the washing rod method has a drawback in that voluminous or large size laundering is not preferred, the same has an advantage in that the entwining of the laundry can be prevented.

The washer of the washing rod method (hereinafter referred to as "rod type washer") is featured in an attached drawing of FIG. 1.

As illustrated in FIG. 1, the rod type washer comprises: a control panel 2 composed of switches for accomodating input of various commands for controlling operations of the washer and a display unit for displaying operational states of the washer; a housing body 4 for being provided with an agitator 6 formed with a washing rod 7 and a washing tub 8 and for supporting each component of the washer; a driving unit 10 for driving the agitator 6 or the washing tub 8 according to a user's command input through the control panel 2 to thereby perform the washing, rinsing, spin-drying and the like; and a door 18 for affording access when the laundry and the like is thrown into or taken out of the washing tub 8.

Meanwhile, the driving unit 10 comprises: a motor 12 for being operated or rotated according to the user's command transmitted through the control panel 2; a first pulley 13*a* fixedly disposed on an axle of the motor 12; a second pulley 13*b* for being rotated by the first pulley by means of a belt 14; and a clutch 15 for receiving the turning effect of the second pulley 13*b* to thereby transmit the same to an axle 16 of the agitator 6 or to the washing tub 8, or to prevent the turning effect of the second pulley 13*b* from being transferred to the axle 16 of the agitator 6 or to the washing tub 8.

Accordingly, when the user opens the door 18 of the washer in order to wash the laundry, throws the laundry and the like into the washing tub 18, operates the switches of the control panel 2 and operates the washer, the washing water is supplied into the washing tub 8 by a supply device (not shown).

At this time, quantity of the washing water supplied by the supply device is determined by the user but there are cases when the water is determined in its quantity according to quantity of the laundry.

In other words, the driving unit 10 rotates the agitator 6 to the left and to the right to measure the quantity of the laundry, and the quantity of the washing water is determined according to the measured quantity of the laundry.

When the above-measured quantity of washing water is supplied to the washing tub 8, the motor 12 in the driving unit 10 is rotated, and the turning effect of the motor 12 is transferred to the clutch 15 through the first pulley 13*a*, the belt 14 and the second pulley 13*b*.

The clutch 15 transmits to the agitator 6 or washing tub 8 the turning effect (power) of the motor through the first pulley 13*a*, belt 14 and the second pulley 13*b*.

In other words, the clutch 15 transmits the power of the motor 12 to the agitator 6 during the washing process, and the agitator 6 is rotated alternately in the left and right directions.

When the agitator 6 is rotated in the left and right directions, the washing rod 7 integrally disposed with the agitator 6 is rotated in the left and right directions along with the agitator 6 to thereby agitate the laundry and washing water.

Accordingly, the laundry is abraded with the agitator 6, washing rod 7, washing tub 8 and the washing water to thereby be washed.

Furthermore, the clutch 15 transfers the power of the motor to the washing tub 8 during a spin-dry process to rotate the tub at a high speed, so that the spin-drying is conducted by centrifugal force.

According to the operational principle thus described, the washer repeatedly performs one time or up to several times the cycle of water supply, washing, draining, spin-drying, rinsing and the like by way of control of a control unit (not shown).

In the case of the rod type washer, the washing rod 7 is disposed at the central area of the agitator 6 and is fixed in its length.

Accordingly, when the laundry is inserted into the washing tub, the laundry usually gets caught by the rod to thereby make it difficult for the laundry to be inserted into the tub.

The rod also occupies lots of space in the tub, and when the laundry is layed on a top area of the rod in a state where the washing water is low in its level, the washing cannot be done properly, thereby causing a reduced washing efficiency.

SUMMARY OF THE INVENTION

The present invention has been provided to solve the aforementioned problem and it is an object of the present invention to provide a variable-length washing rod of a washer wherein the length of the rod is variable according to the water level in the washing tub to thereby facilitate the insertion of the laundry into the tub and to thereby prevent the laundry from being improperly washed as a result of being caught on a top area of the rod even the case of a lower water level. The invention improves the laundering efficiency.

In order to obtain the object of the present invention, the variable-length washing rod of a washer comprises: a first rod member disposed on a top side of an agitator and rotated by a driving means of the washer; and a second rod member raisable relative to the first rod member, e.g., by a buoyancy action.

BRIEF DESCRIPTION OF THE DRAWINGS

For a fuller understanding of the nature and objects of the invention, reference should be made to the following detailed description taken in conjunction with the accompanying drawings in which:

FIG. 4*b* is a vertical sectional view of the connecting rod member of FIG. 4a;

DETAILED DESCRIPTION OF PREFERRED EMBODIMENTS OF THE INVENTION

Figure 2:
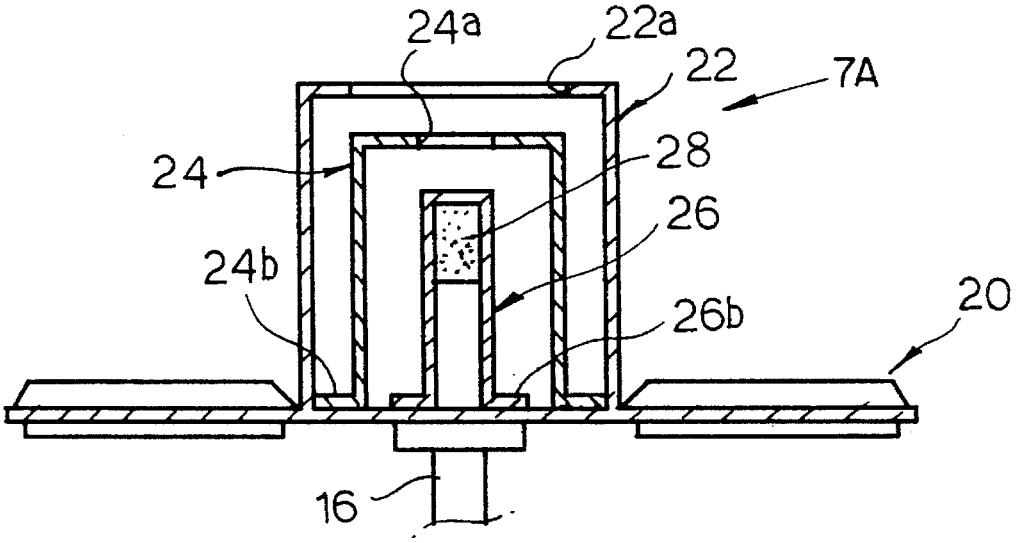
FIG. 2 is a vertical sectional sectional view of an agitator for illustrating one embodiment of a variable washing rod according to the present invention.

FIG. 2 is a sectional view of an agitator for illustrating one embodiment of a variable-length washing rod according to the present invention.

According to FIG. 2, an axle 16 is extending from a base 20A of agitator 20.

Figure 1:
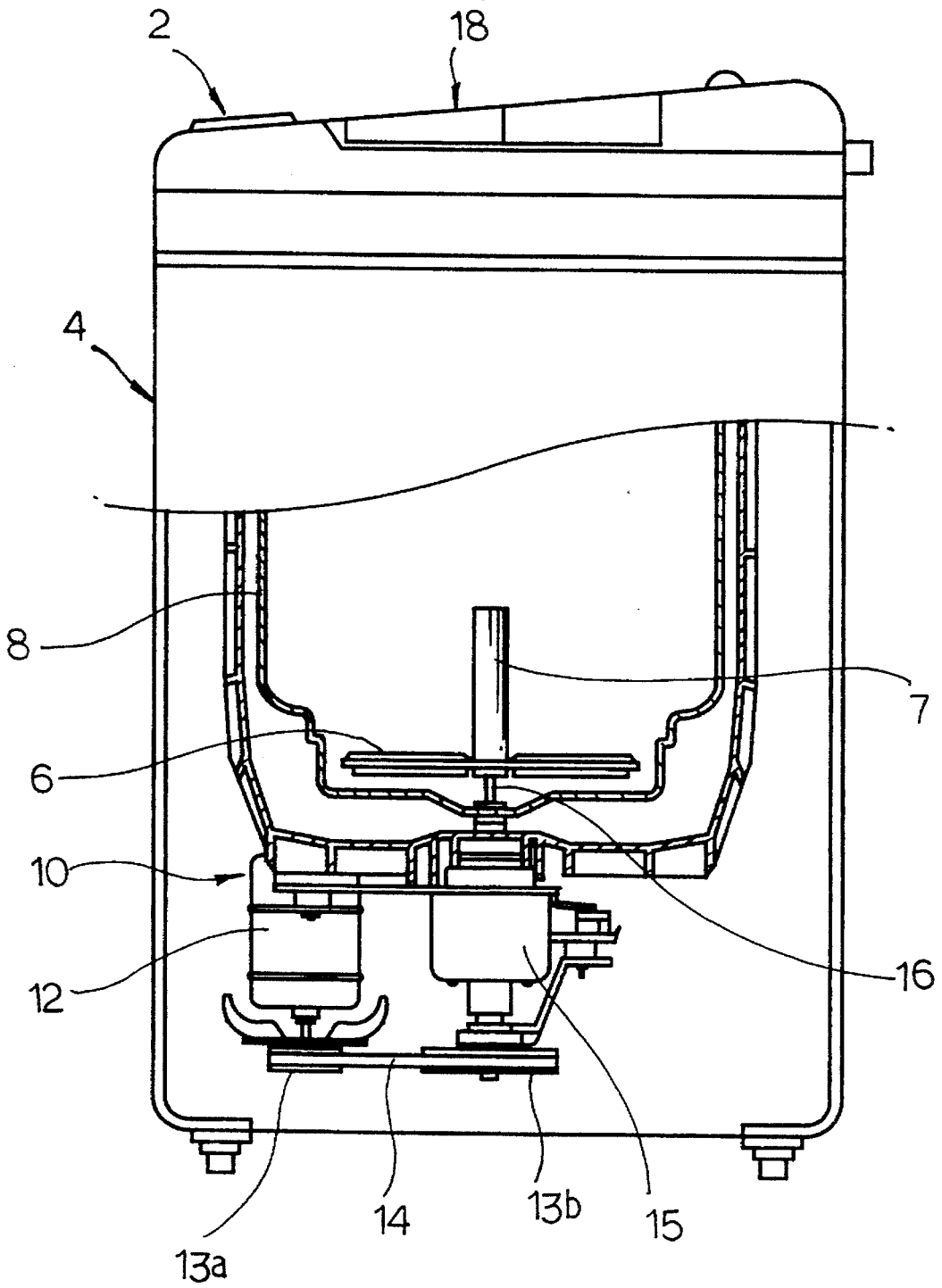
FIG. 1 (Prior Art)
FIG. 1 is a schematic partial vertical sectional view of a conventional washer with a washing rod.

The axle 16 is rotated by the power of the driving unit 10 via the clutch 15 (see FIG. 1).

Mounted on the agitator is a variable-length washing rod 7A according to the invention. The washing rod 7A includes a first rod member 22 formed at a central area of the base 20A of the agitator 20.

The first rod member 22 has a cylindrical shape with a void therein, and a top surface of the first rod member has formed therein and a top surface of the first rod a hole 22*a* of a predetermined diameter d1.

The first rod member 22 can be integrally formed with the base 20A of the agitator 20 or can be fastened to the base 20A of the agitator 20 by utilizing a separate fastening member.

Telescopically disposed in the void of the connecting rod member 24.

The connecting rod member 24 has a cylindrical shape of a smaller diameter d2 compared with the predetermined diameter of the hole 22*a* formed centrally in the top surface of the first rod member 22, a top surface of the member 24 is formed with a hole 24*a* of a predetermined diameter at d3 a central region thereof. The member 24 is also provided at a lower end thereof with a protruded hitch or frame 24*b* whose diameter is larger than that of the hole 22*a* formed on the top surface of the first rod member 22.

Disposed inside of connecting rod member 24 is a second rod member 26.

The second rod member 26 has a cylindrical shape whose diameter d4 is smaller than that of the hole 24*a* formed on the top surface of the connecting rod member 24, and is provided at a lower end thereof with a protruded hitch or flange 26*b* whose diameter is larger than that of the hole 24*a* formed at the top surface of the connecting rod member 24.

Telescopingly disposed inside of the second rod member 26 is a buoy 28.

Figure 3:
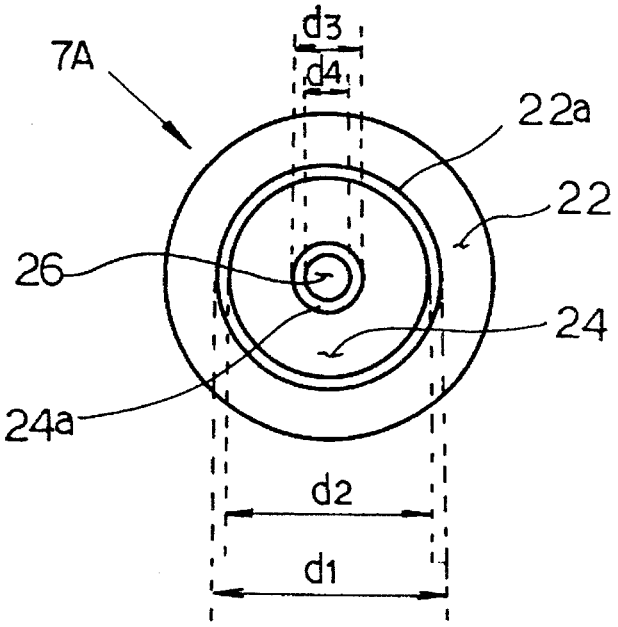
FIG. 3 is a plan view of the variable washing rod illustrated in FIG. 2.

FIG. 3 is a plan view of the variable-length washing rod illustrated in FIG. 2.

Figure 4A:
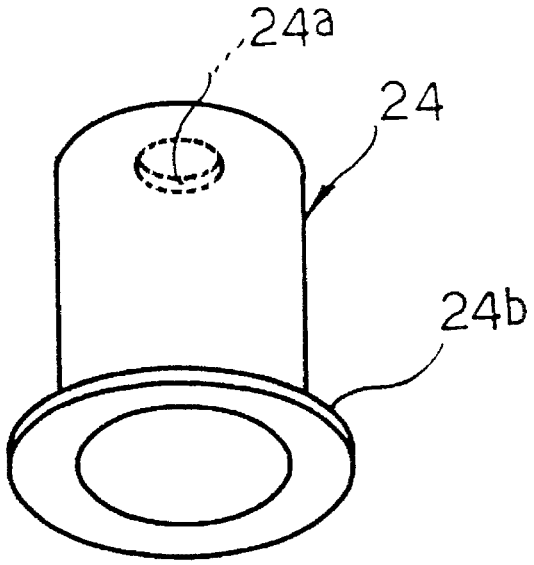
FIG. 4*a* is a bottom perspective view of a connecting rod member of the variable washing rod illustrated in FIG. 2.
Figure 4B:
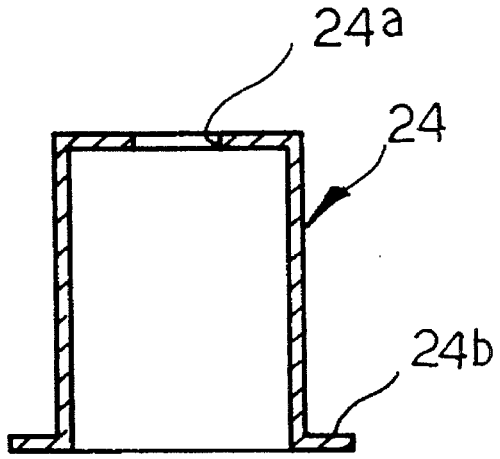

FIGS. 4*a* and 4*b* are structural drawings of the connecting rod member (third rod member) 24 on the variable washing rod illustrated in FIG. 2.

Figure 5A:
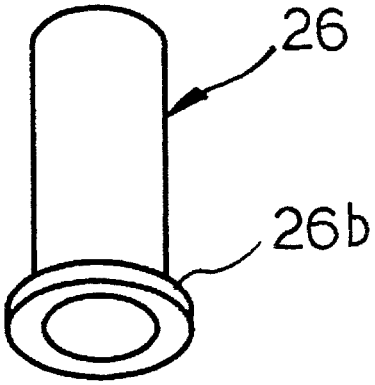
FIG. 5*a* is a bottom perspective view of the second rod member of the variable-length washing rod illustrated in FIG. 2.
Figure 5B:
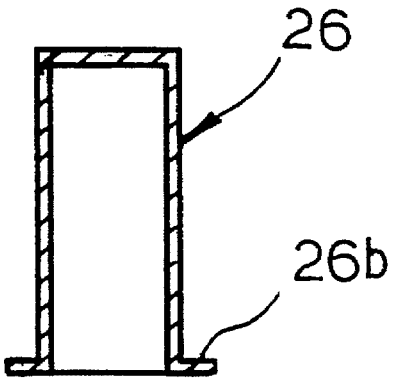
FIG. 5*b* is a vertical sectional view of the second rod member of FIG. 5*a;*

FIGS. 5*a* and 5*b* are structural drawings of the second rod member 26 in the variable-length washing rod illustrated in FIG. 2.

Figure 6A:
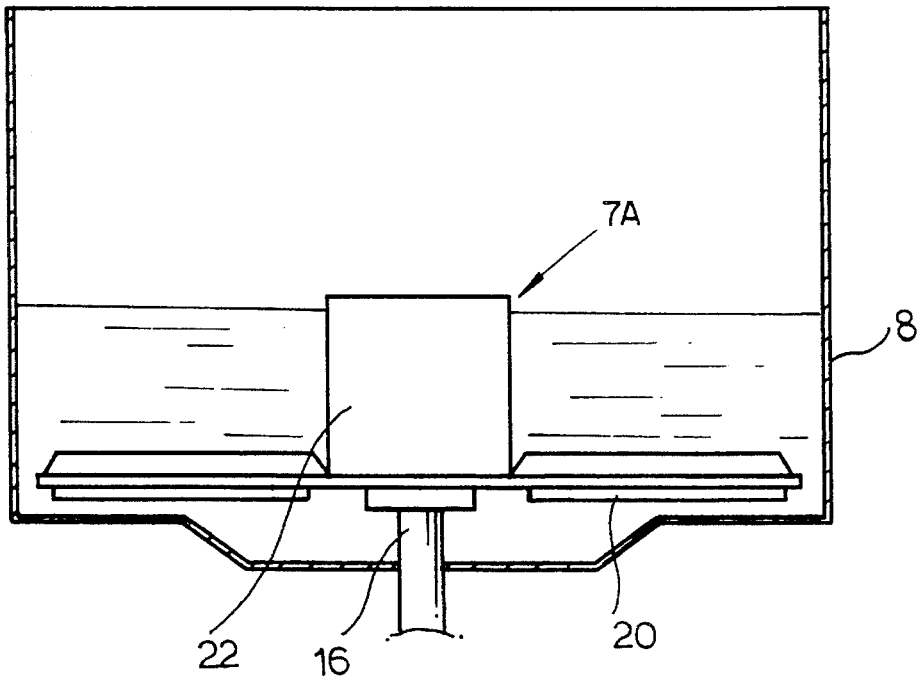
FIGS. 6*a*, 6*b* and 6*c* are schematic views depicting various operational states of the variable washing rod according to the present invention.
Figure 6B:
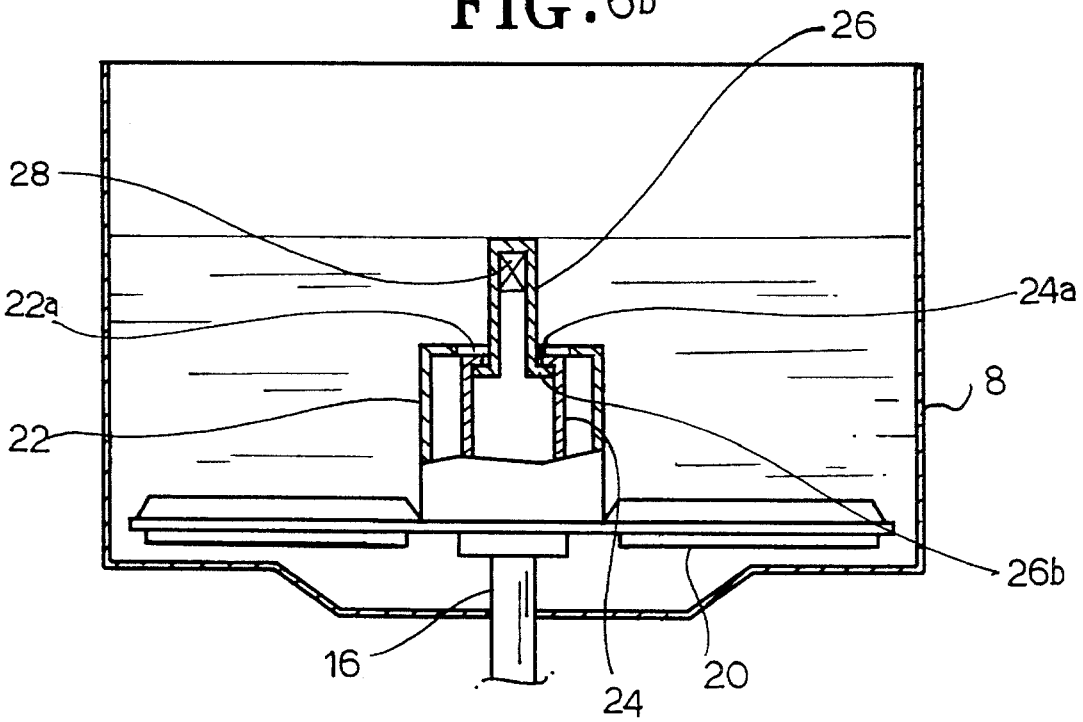
Figure 6C:
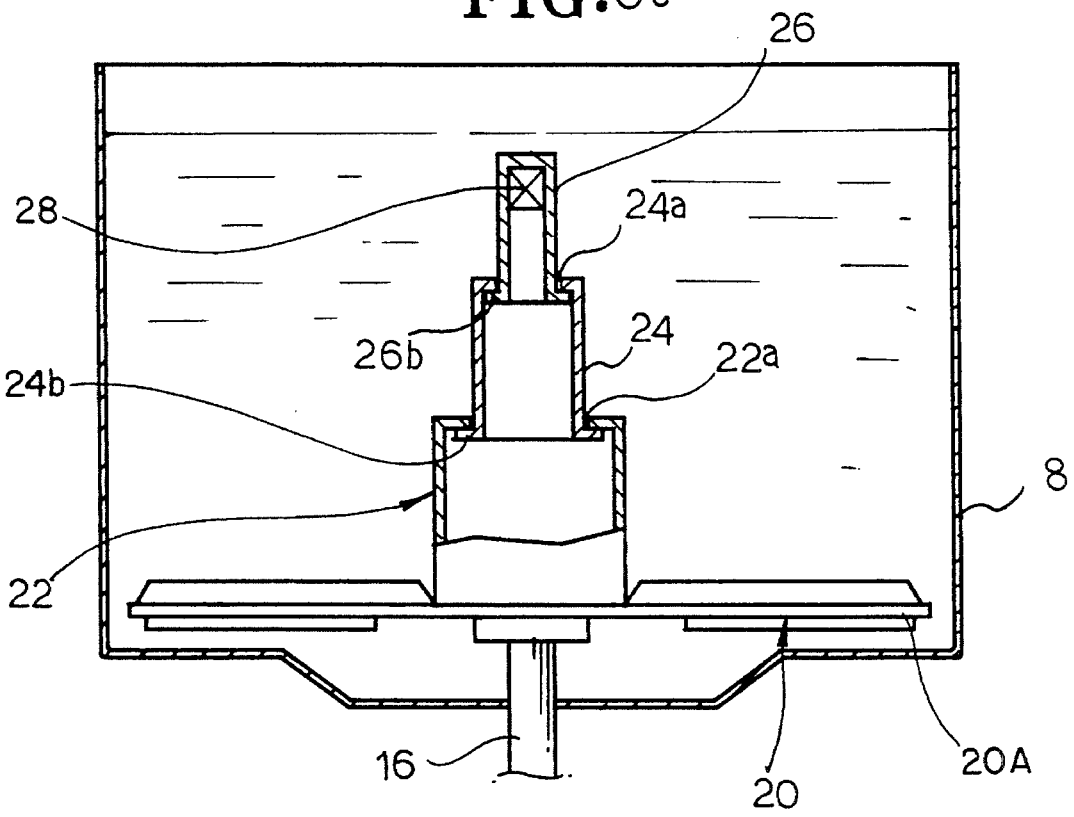

FIGS. 6*a*, 6*b* and 6*c* are schematic diagrams for explaining the operation of the variable-length washing rod according to the present invention.

FIG. 6*a* illustrates the washer when the water level in the tub 8 is low, which is the case when level of the water supplied to the tub 8 is lower in height than the first rod member 22.

When the water is supplied continuously to the tub 8, the water level becomes higher than the first rod member as illustrated in FIG. 6*b*.

According to FIG. 6*b*, when the water level becomes higher, the water flows into the connecting rod member 24 through the holes 22*a* and 24*b* formed on the top surfaces of the first and second rod members 22 and 24 respectively.

When the water rushes into the connecting rod member 24, the buoy 28 rises due to its buoyancy, and the second rod member 26 rises along with the buoy 28.

FIG. 6*c* represents the washer where the water level in the tub is high, and as illustrated in FIG. 6*b*, when the water reaches an intermediate water level, the water flows into the connecting rod member 24 through the holes 22*a* and 24*a* formed at the top surfaces of the first and second rod members 22 and 24.

When the water is supplied into the connecting rod member 24, the buoy 28 rises due to its buoyancy, and the second rod member 26 also rises up along with the buoy 28.

When the second rod member 26 rises up with strong buoyant force by way of the buoy 28, the protruded hitch 26*b* of the second rod member 26 abuts the top surface of the connecting rod member 24 so that the rod member 24, along with the connecting rod member 24.

At this time, the connecting rod member 24 rises up until the protruded hitch 24*b* abuts the top surface of the first rod member 22.

When the washing is conducted under this state, the variable-length rod composed of the first, second and third rods 22, 24 and 26 does not protrude up above the water level and the hitches 24*b*, 26*b* are not dislodged by water current even with the laundry being caught up by the variable rod whereby laundry will not be entwined by the hitches.

Furthermore, during spin-dry after completion of the washing, the water level in the washing tub 8 gradually comes down, the second rod member 26 of the variable rod falls back into the connecting rod member 24 according to the water level, and the connecting rod member 24 is in turn caused to fall back into the first rod member 22 to thereby cause the rod member to be reduced in its length, so that the laundry will not be caught during input of the laundry.

In FIGS. 6*a*, 6*b* and 6*c*, reference numeral 20 references the agitators, 16 references the axle of the agitator 20.

Figure 7:
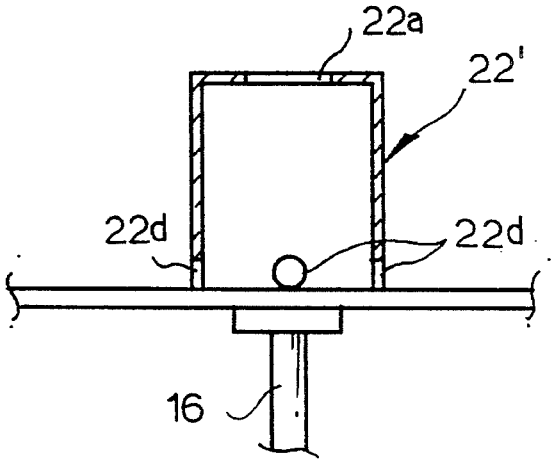
FIG. 7 is a vertical sectional view of another embodiment of the first rod member according to the present invention.

FIG. 7 is a sectional view of the agitator for illustrating another embodiment of the first rod member 22 of the variable-length washing rod according to the present invention.

According to FIG. 7, the first rod member 22' the washing rod has a cylindrical shape, on the central top surface of which there is formed the hole 22*a*, and there is formed a circulation hole 22*d* at a lower end thereof through which the washing water can flow in and out.

Figure 8A:
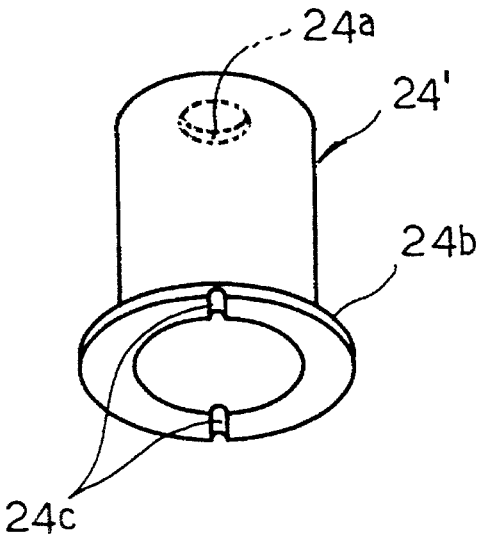
FIG. 8*a* is a bottom perspective view of yet another embodiment of the connecting rod member of the variable-length washing rod according to the present invention.
Figure 8B:
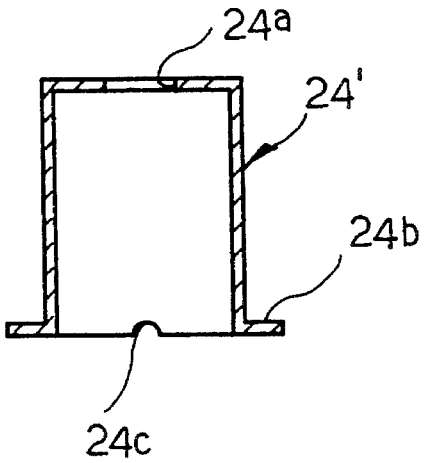
FIG. 8*b* is a vertical sectional view of the connecting rod member of FIG. 8*a;*

FIGS. 8*a* and 8*b* are structural drawings for illustrating another embodiment of the connecting rod member 24' the variable-length washing rod according to the present invention.

According to FIGS. 8*a* and 8*b*, the connecting rod member 24' of the washing rod has a cylindrical shape, on a central top surface of which there is formed the hole 24*a*, and there is formed the protruded hitch 24*b* at the lower end thereof.

There is formed a circulation hole 24*c* at a lower surface of the protruded hitch 24*b* through which the washing water can flow in and flow out.

Figure 9:
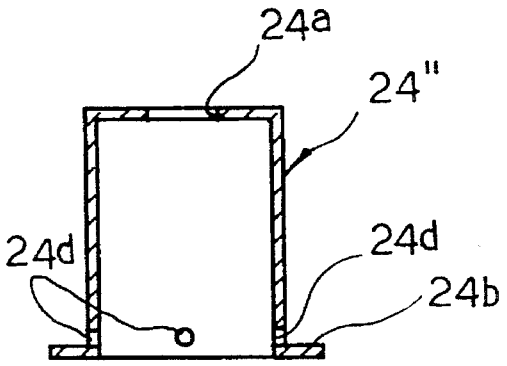
FIG. 9 is a vertical sectional view of still another embodiment for the connecting rod member of the variable-length washing rod according to the present invention.

FIG. 9 is a structural drawing of still another embodiment of the connecting rod member 24" on the variable washing rod according to the present invention.

According to FIG. 9, the connecting rod member 24" has a cylindrical shape, on the top central surface of which there is formed the hole 24*a* and there is formed the protruded hitch 24*b* at the lower end thereof. A circulation hole 24*d* is formed at a top side of the protruded hitch 24*b*, so that the washing water can flow in and flow out therethrough.

Figure 10A:
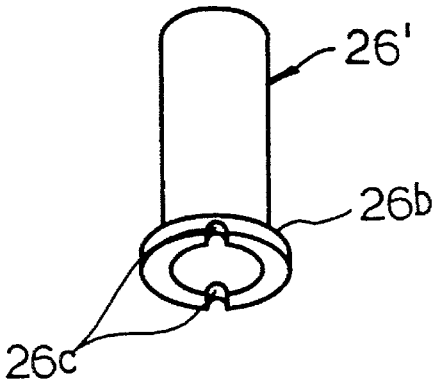
FIG. 10*a* is a bottom perspective view of another embodiment of the second rod member of the variable-length washing rod according to the present invention.
Figure 10B:
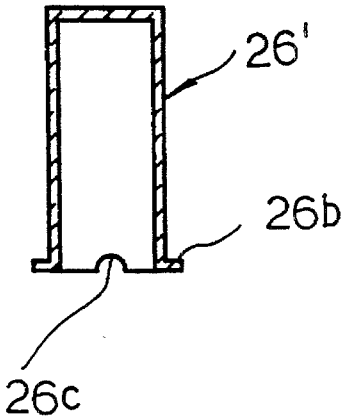
FIG. 10*b* is a vertical sectional view of the second rod member depicted in FIG. 10*a;*

FIGS. 10*a* and 10*b* are structural drawings of another embodiment for the second rod member 26' on the variable washing rod according to the present invention. According to FIGS. 10*a* and 10*b*, there is formed a protruded hitch 26*b* under the second rod member 26' and there is formed a circulation hole 26*c* under the protruded hitch 26*b*, through which the washing water can flow in and flow out.

Figure 11:
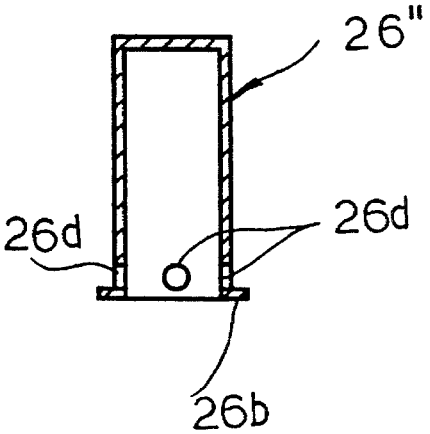
FIG. 11 is a vertical sectional view of still another embodiment for the second rod member of the variable washing rod according to the present invention.

FIG. 11 is a structural drawing of still another embodiment of the second rod member 26" of the variable washing rod according to the present invention. According to FIG. 11, there is formed the protruded hitch 6*b* under the second rod member 26, and there is a circulation hole 26*d* above the protruded hitch 26*b* through which the water can flow in and out.

Figure 12:
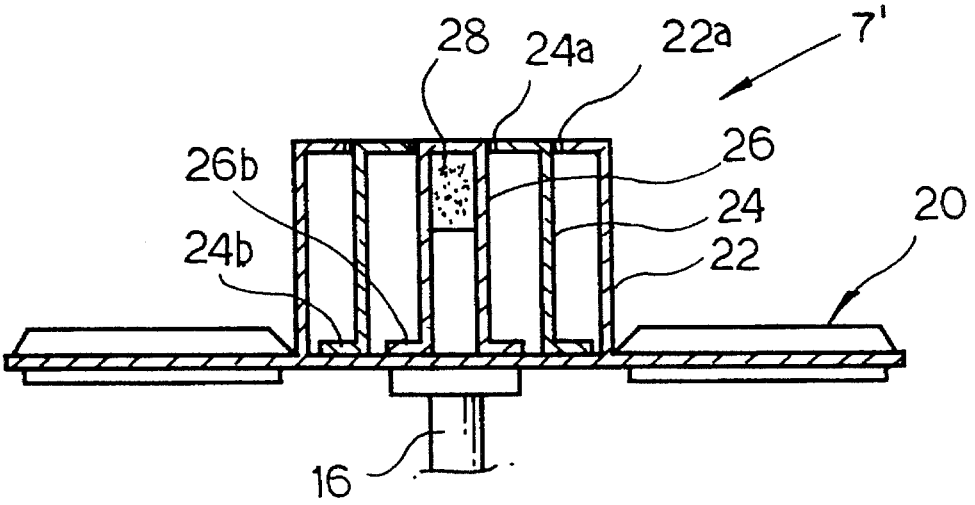
FIGS. 12 and 13 are vertical sectional views of other embodiments of the variable-length washing rod according to the present invention.
Figure 13:
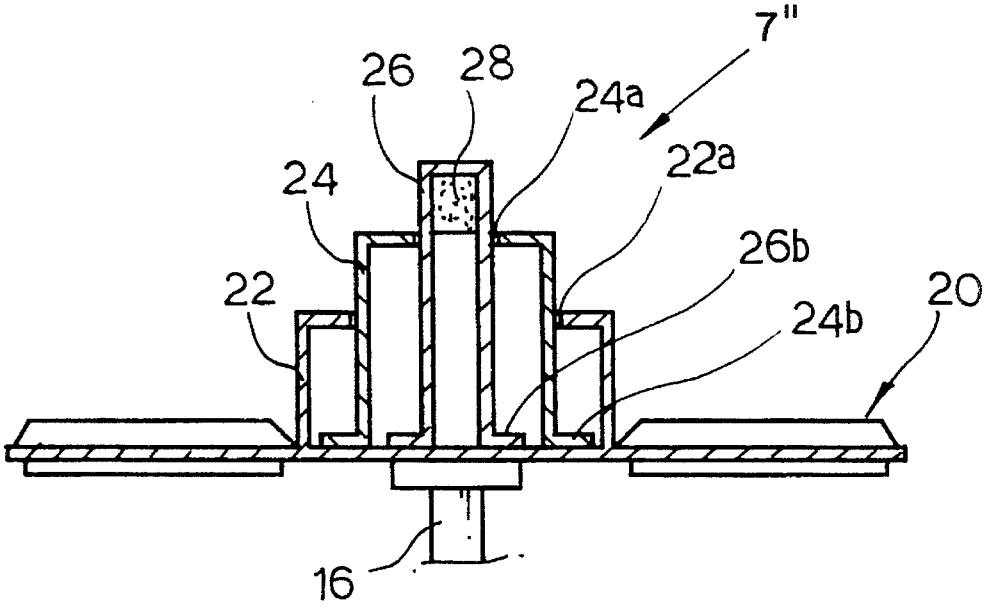

FIGS. 12 and 13 are sectional views of the agitator for illustrating two further embodiments of the variable washing rod 7', 7' according to the present invention.

According to FIG. 12, the first, second and third rod members 22, 24, and 26 are of the same height (or length) unlike the embodiment explained in connection with FIG. 2.

According to FIG. 13, the connecting rod member 24 is longer than the first rod member 22 in its height, and the second rod member 26 is longer than the connecting rod member 24 in its height.

In FIG. 13, like reference numerals are used for designation of like or equivalent construction in FIG. 2 for simplicity of illustration and explanation, so detailed descriptions are omitted.

As seen from the foregoing, by way of the variable washing rod of a washer according to the present invention, it is easy to put the laundry into the washing tub because the washing rod is short in its length at an initial stage of washing, so that the tub defines a larger space, and the washing rod is lengthened according to quantity of the washing water without the laundry being entwined, which also helps obtain an effect of preventing the laundry from being damaged.

Furthermore, because the variable-length washing rod varies in its length according to the water level the extended washing rod will not be higher than the water surface, so that the laundry is prevented from being caught on a top area of the washing rod to thereby obtain an increased washing efficiency.

The foregoing description of the preferred embodiments has been presented for the purpose of illustration and description. Still other variations and modifications are possible without departing from the spirit and scope of the present invention.

Specifically, even though the abovementioned descriptions relate to first, second and third rod members having planar top surfaces, it should be apparent that the objects of the present invention can be obtained even with slanted top surfaces of the rod members.

Furthermore, even though the aforesaid descriptions have dealt with structures where sides of the first, second and third rod members are parallel with the axle of the agitator, it should be noted that the objects of the present invention can be accomplished even with slanted sides of the rod members.

Figure 3A:
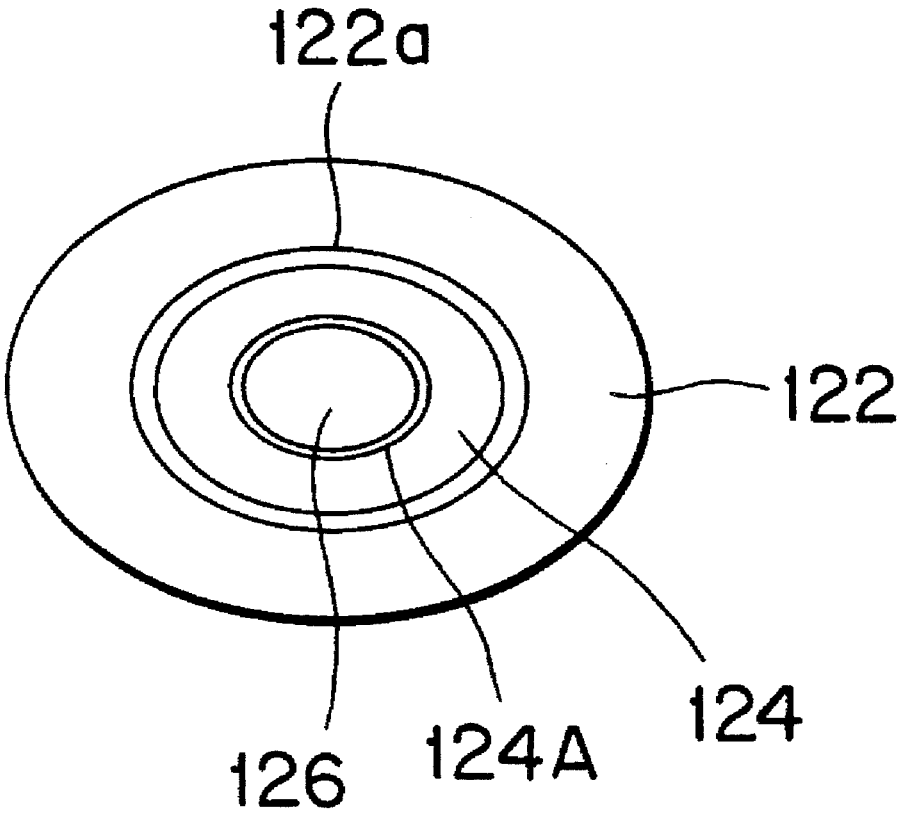
FIG. 3*a* is a view similar to FIG. 3 of an alternative shape of the washing rod.

Still furthermore, even though the foregoing descriptions relates to first, second and third rod members of circular shapes in their sectional views, it should be apparent that oval shapes of the rod members in their sectional views also fall within the purview of the present invention. In that regard, attention is directed to FIG. 3A showing such an oval configuration of the washing rod, wherein the items corresponding to those of FIG. 3 have been given the same reference numerals increased by 100.

Still furthermore, even though the present invention has described the variable-length washing rod as comprising three rod members, it should be apparent that the objects of the present invention can be accomplished by a variable washing rod comprising two or more rod members.

What is claimed is:

1. A clothes washing machine agitator comprising a vertical washing rod of adjustable height, said washing rod including a plurality of relatively vertically movable, telescopingly arranged rod members, enabling a height of said washing rod to be adjusted, wherein one of said rod members is buoyant in wash water to be raised by a buoyancy action.

2. The agitator according to claim 1 wherein there are more than two of said relatively moveable rod members.

3. The agitator according to claim 1, wherein a first of said rod members is fixed against vertical movement, and wherein said one rod member constitutes a second rod member which is raisable relative to said first wash rod by the buoyancy action.

4. The agitator according to claim 3, wherein said second rod member contains a buoyant member therein.

5. The agitator according to claim 3, wherein said first rod member includes a water circulation opening for enabling wash water to reach said buoyant second rod member.

6. The agitator according to claim 3, wherein said washing rod includes a third rod member situated between said first and second rod members and arranged to be raised along with said second rod member for a portion of the vertical travel of said second rod member, said second rod member being raisable past an uppermost position of said third rod member.

7. The agitator according to claim 6, wherein said first rod member includes a top hole through which said second and third rod members can pass, said first rod member including a stop surface against which a lower portion of said third rod member abuts to define said uppermost position thereof, said third rod member including a top hole through which said second rod member can pass, said third rod member including a stop surface against which a lower portion of said second rod member abuts to define an uppermost position thereof.

8. The agitator according to claim 6, wherein said third rod member includes a water circulation opening for enabling wash water to reach said buoyant second rod member.

9. The agitator according to claim 1, wherein said rod members are of non-circular cross sectional shape.

10. The agitator according to claim 1, wherein said agitator includes a base connectible to a rotary drive shaft, another of said rod members being integral with said base.

11. The agitator according to claim 1, wherein said agitator includes a base connectible to a rotary drive shaft, another of said rod members being fastened to said base.

12. The agitator according to claim 1, wherein a first of said rod members is fixed against vertical movement and includes a top surface with a hole formed therein, wherein said one rod member constitutes a second rod member which is disposed inside of said first rod member and movable vertically relative thereto through said hole.

13. A clothes washing machine comprising:

a tub;

a basket disposed in said tub;

an agitator disposed in said basket; and a drive mechanism for rotationally oscillating said agitator;

said agitator comprising:

a base connected to said drive mechanism, and a variable-height washing rod including a plurality of relatively vertically movable, telescopingly arranged rod members, enabling said washing rod to be vertically extended and retracted, wherein one of said rod members is buoyant in wash water and raisable by a buoyancy action.

* * * * *